US007335877B1

(12) United States Patent
Han et al.

(10) Patent No.: US 7,335,877 B1
(45) Date of Patent: Feb. 26, 2008

(54) INLINE AUTOMATED CHEMICAL ANALYSIS SIGNAL OPTIMIZATION

(75) Inventors: Ye Han, San Jose, CA (US); Yuzhong Wang, Palo Alto, CA (US); Wenjing Yang, Sunnyvale, CA (US)

(73) Assignee: Metara, Inc., Sunnyvale, CA (US)

( * ) Notice: Subject to any disclaimer, the term of this patent is extended or adjusted under 35 U.S.C. 154(b) by 0 days.

(21) Appl. No.: 11/323,080

(22) Filed: Dec. 30, 2005

(51) Int. Cl.
*H01J 49/04* (2006.01)

(52) U.S. Cl. ..... 250/288; 250/281; 250/282; 250/289; 250/292; 422/100

(58) Field of Classification Search ..... None
See application file for complete search history.

(56) References Cited

U.S. PATENT DOCUMENTS 5,504,327 A * 4/1996 Sproch et al. ..... 250/288
6,593,568 B1 * 7/2003 Whitehouse et al. ..... 250/288
2002/0164816 A1 * 11/2002 Quake ..... 436/161
2006/0099116 A1 * 5/2006 Manger et al. ..... 422/100

* cited by examiner

*Primary Examiner*—Jack I. Berman
*Assistant Examiner*—Zia R. Hashmi
(74) *Attorney, Agent, or Firm*—Jonathan W. Hallman; MacPherson Kwok Chen & Heid LLP

(57) ABSTRACT

An apparatus and method for improved inline and automated chemical analysis is provided, in particular disclosing signal optimization for an electrospray ionization mass spectrometer apparatus. A substantially inert pathway for ion analysis is provided by using substantially inert metals or polymers for pathway parts. Other enhancements and advantages are also disclosed, including an advantageous probe profile and metal foil cover.

12 Claims, 5 Drawing Sheets

INLINE AUTOMATED CHEMICAL ANALYSIS SIGNAL OPTIMIZATION

TECHNICAL FIELD

The present invention relates generally to chemical analysis and, more particularly, to an apparatus and method for inline and automated chemical analysis with signal optimization.

BACKGROUND

Systems and apparatus for measuring the concentration of analytes in a sample have been developed using a number of analytical techniques such as chromatography, spectroscopy, and mass spectrometry. In particular, mass spectrometry is often the technique of choice to achieve sensitivity for trace and ultra-trace analysis in which the analyte concentration may be as small as parts per billion (ppb) or sub-ppb such as parts per trillion (ppt). For example, commonly assigned U.S. patent application Ser. Nos. 10/086,025 and 10/094,394 disclose automated analytical apparatuses that measure contaminants or constituents present in trace concentrations, the full disclosures of which are hereby incorporated by reference for all purposes.

Trace contaminant metrology (TCM) and chemical composition metrology (CCM) tools, both available from Metara Inc. of Sunnyvale, Calif., rely on an electrospray ionization time-of-flight mass spectrometer (ESI TOF MS) for the measurement and quantitation of analytes. Commercial ESI TOF MS instruments are not suitable for measurement of trace metals in industrial process solutions, for example those used in the semiconductor industry, due to interfering contamination that is introduced from component parts and due to degradation of trace contamination signal strength that can be caused by contamination build up in certain locations along the sample pathway. With continued sampling and analysis, contaminants from the ESI TOF MS system and residue from the process solution may accumulate in the sampling and analysis pathway, increasing inaccuracy, lowering spectrometer resolution, and further reducing sensitivity for trace contamination measurement. In order to acquire high resolution data with high sensitivity, a clean and easily maintained mass spectrometer system is required.

Accordingly, apparatus modifications and methods for instrument induced contamination reduction and signal optimization are essential for successful inline and automated chemical analysis of trace contamination.

SUMMARY

An apparatus and method for improved inline and automated chemical analysis is provided, in particular disclosing signal optimization for an electrospray ionization mass spectrometer apparatus. A substantially inert pathway for ion analysis is provided by using substantially inert metals or polymers for pathway parts. Other enhancements and advantages are also disclosed, including an advantageous probe profile and metal foil cover.

In one embodiment of the present invention, a mass spectrometer apparatus for monitoring a fluid system is provided, the apparatus comprising: a sample introduction tube; an electrospray ionization (ESI) probe with a shroud; a union coupling the sample introduction tube and the ESI probe; a capillary assembly with an endcap to which the ESI probe is aligned; a skimmer cone operably coupled to the capillary assembly; an ion guide operably coupled to the skimmer cone; and an ion detection module operably coupled to the ion guide. The ESI probe, the shroud, the union, the endcap, and the skimmer cone are comprised of a substantially inert metal or polymer to provide a substantially inert pathway for ion analysis.

In accordance with another embodiment of the present invention, a method of monitoring a fluid system via electrospray ionization time-of-flight mass spectroscopy is provided, the method comprising: providing a substantially inert pathway from a sample introduction tube, through an electrospray ionization probe with a shroud, through a capillary assembly, through a skimmer cone, through an ion guide, and to an ion detection module; flowing a sample through the substantially inert pathway; and analyzing the sample via electrospray ionization time-of-flight mass spectroscopy.

Advantageously, the present invention enables trace contamination signal optimization without the introduction of interfering contamination from the ESI components enabling high sensitivity inline and automated chemical analysis of industrial process solutions. (It should be noted that industrial process solutions are not the only application of this high sensitivity capability, for example the same capability may be applied in biological and environmental applications.)

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

Figure 1:
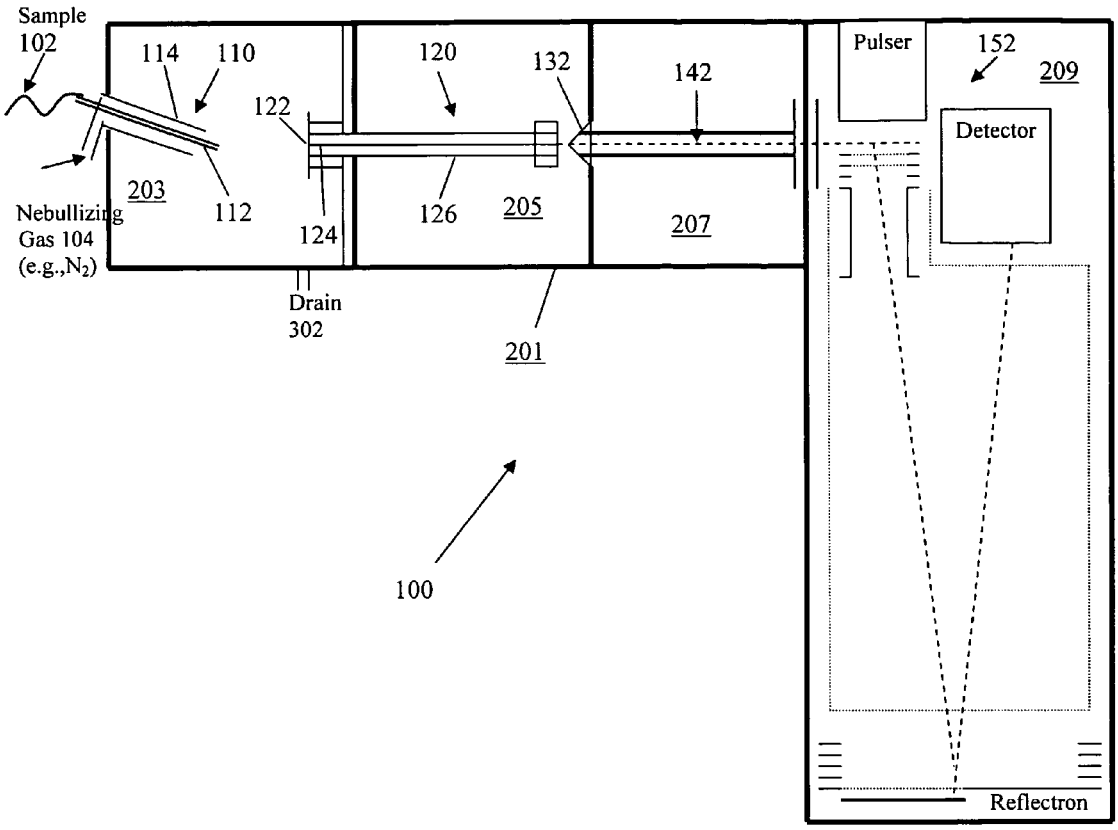
FIG. 1 illustrates an electrospray ionization mass spectrometer in accordance with an embodiment of the present invention.

Embodiments of the present invention and their advantages are best understood by referring to the detailed description that follows. It should be appreciated that like reference numerals are used to identify like elements illustrated in one or more of the figures. It should also be appreciated that the figures may not be necessarily drawn to scale.

DETAILED DESCRIPTION

The present invention provides apparatus and methods for improved inline and automated chemical analysis, in particular disclosing signal optimization for trace contamination measurement by mass spectroscopy.

Referring now to FIGS. 1-8, an electrospray ionization (ESI) mass spectrometer system 100 and some of its parts are illustrated in accordance with an embodiment of the present invention. System 100 includes sample introduction through a tube 102 (e.g., comprised of perfluoro-alkoxyalkane) and a nebulizing gas line 104, both operably coupled to an ESI probe assembly 110, which includes an ESI probe 112 and a probe shroud 114. A capillary assembly 120, to which the ESI probe 112 is operably aligned, includes a capillary 126 with an end cap 122 and a nose piece 124 being positioned between the ESI probe 112 and the capillary assembly 120. A skimmer cone 132 and an ion guide 142 are operably coupled to capillary assembly 120 for guiding ions of interest to an ion detection module 152 (e.g., a TOF MS detector module). In one embodiment, skimmer cone 132 is a cone shaped metal piece with a small hole at the cone tip for allowing ions to pass, the skimmer cone acting as an interface between two different vacuum stages (e.g., from about 1 torr to about $10^{-3}$ torr). The skimmer cone may be positioned with appropriate accessories or parts such as retaining rings and spacers.

These components may be housed in a housing 201, which may be a single housing or separate housings operably combined. In one embodiment, ESI probe 112 and probe shroud 114 are partially housed within a spray chamber 203 of housing 201 and a drain 302 is provided for spray chamber 203. Capillary assembly 120 may be housed in a capillary housing 205, skimmer cone 132 and ion guide 142 may be housed in a housing 207, and the ion detection module 152 may be housed in a housing 209.

Figure 2:
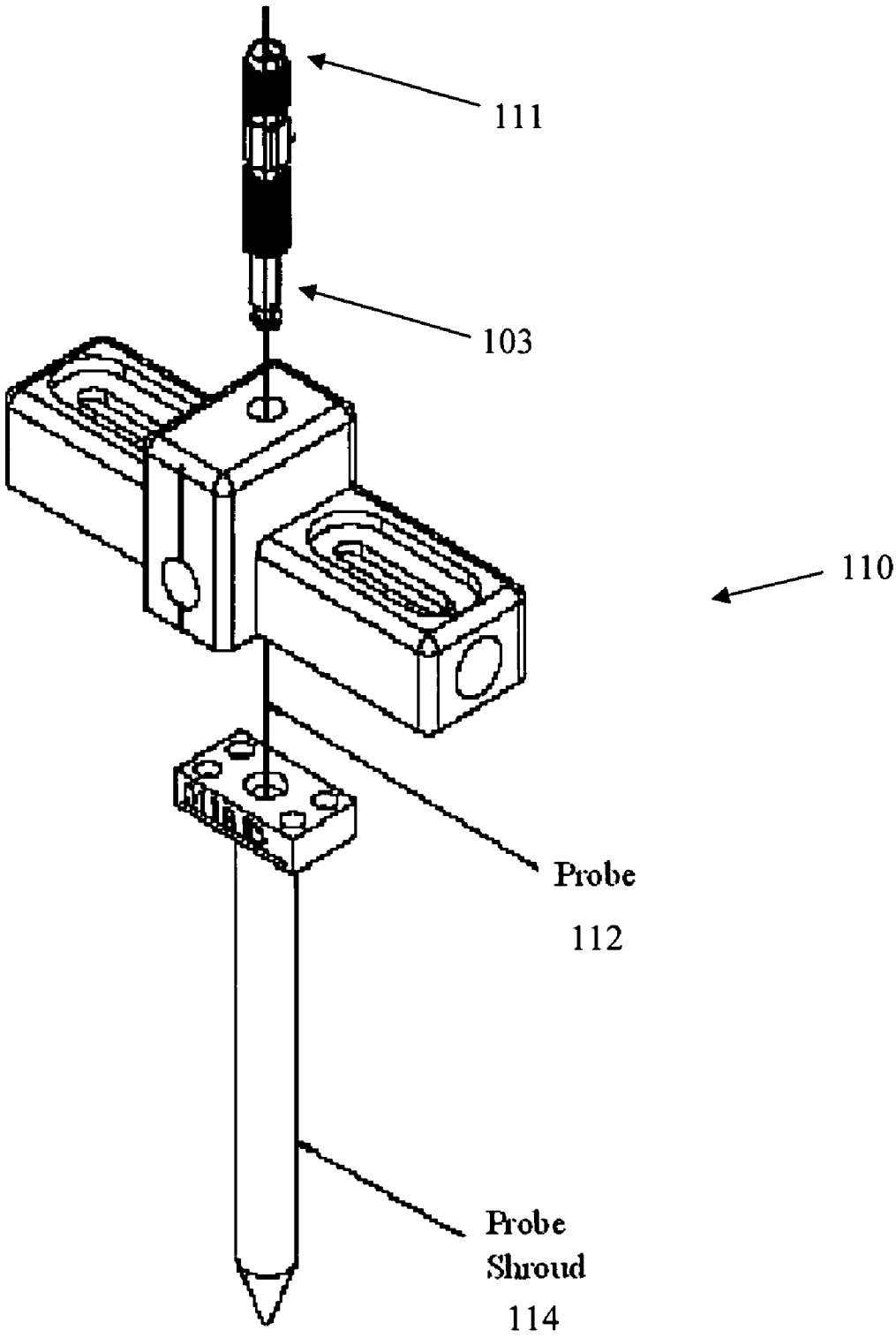
FIG. 2 illustrates an electrospray ionization probe assembly in accordance with an embodiment of the present invention.

FIG. 2 illustrates ESI probe assembly 110 in accordance with an embodiment of the present invention. Probe assembly 110 includes a union 111 which provides an interface/connection between ESI probe 112 and sample introduction tube 102, an ESI probe nut 103, and probe shroud 114.

Figure 3:
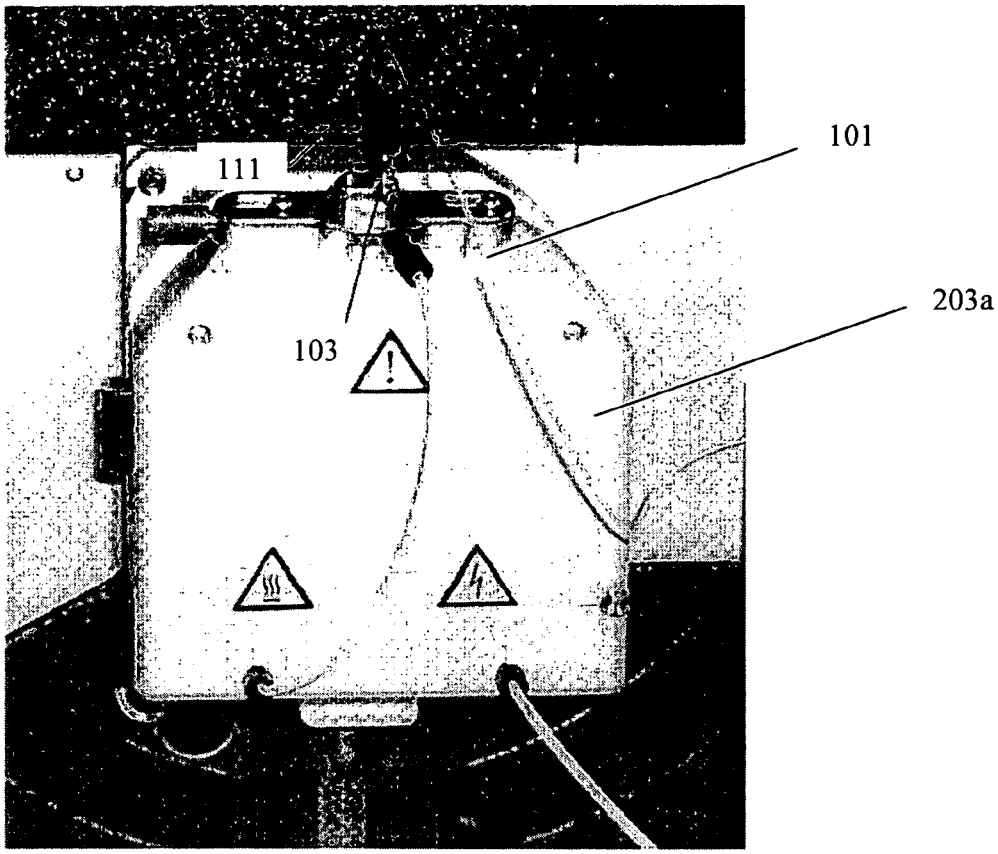
FIG. 3 illustrates the exterior of a spray chamber in accordance with an embodiment of the present invention.
Figure 4:
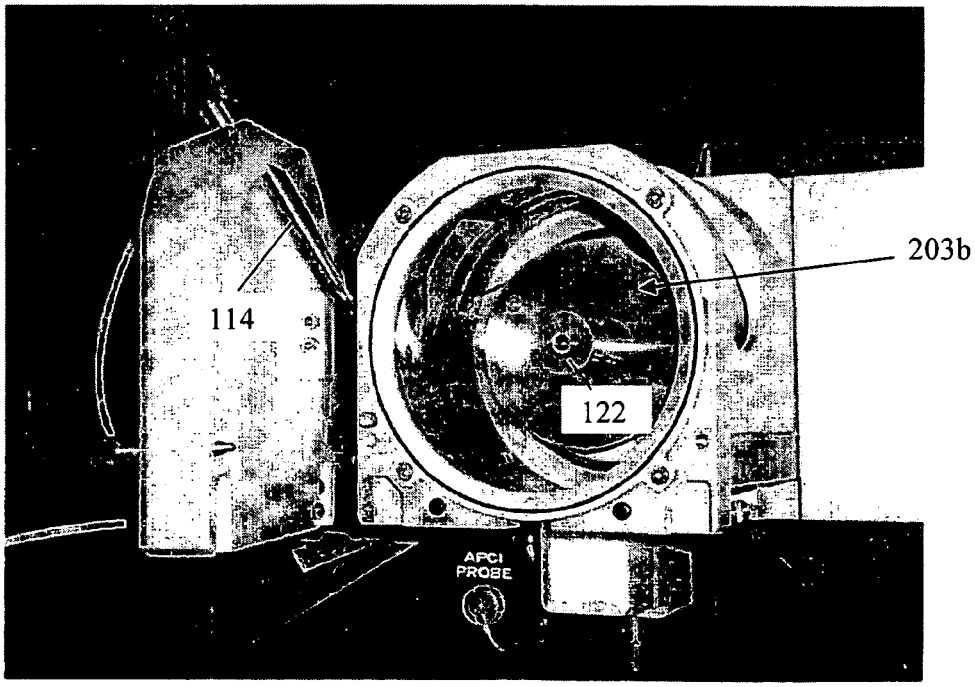
FIG. 4 illustrates the interior of a spray chamber in accordance with an embodiment of the present invention.
Figure 5:
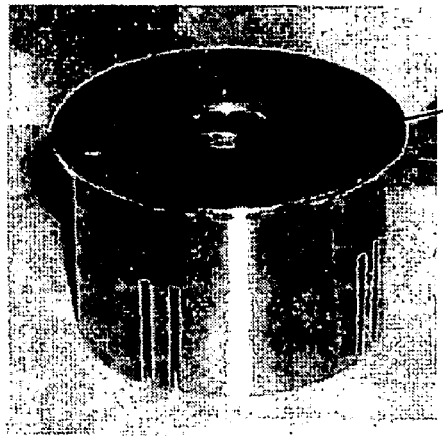
FIG. 5 illustrates an endcap in accordance with an embodiment of the present invention.
Figure 6:
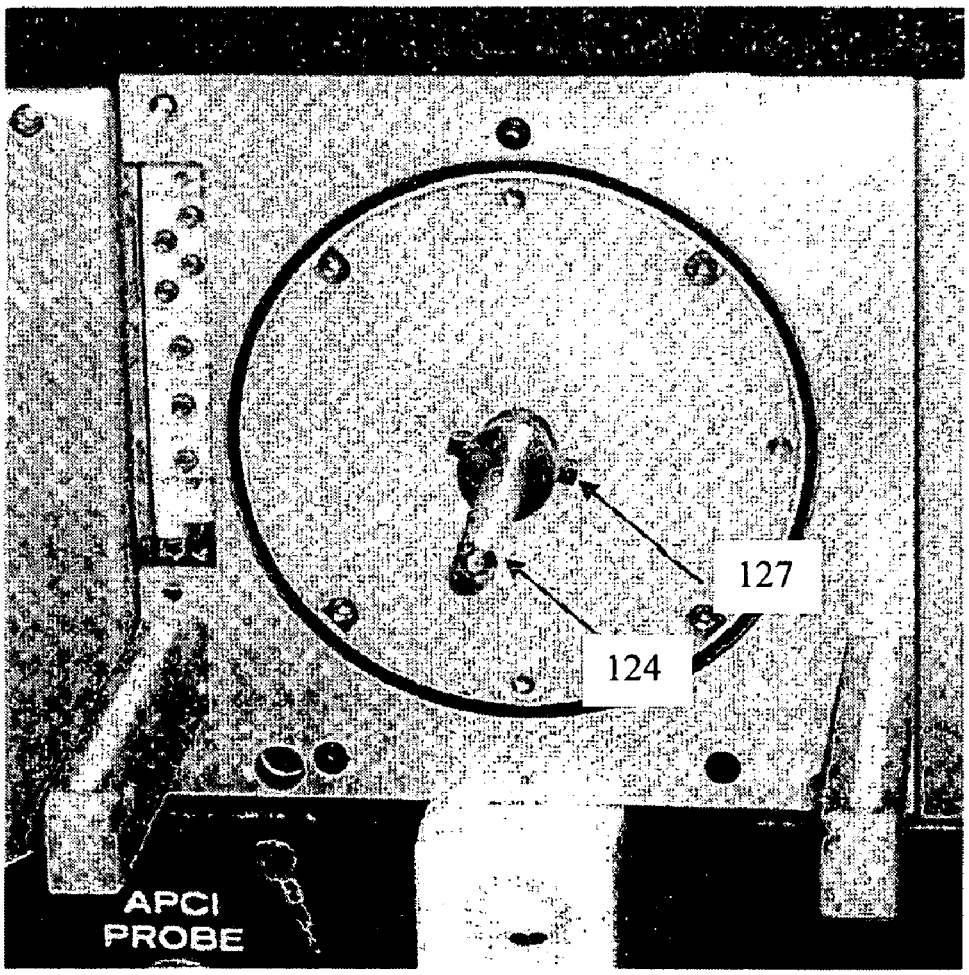
FIG. 6 illustrates a nose piece after the spray chamber has been removed in accordance with an embodiment of the present invention.

FIG. 3 illustrates the exterior 203*a* of spray chamber 203, and FIG. 4 illustrates the interior 203*b* of spray chamber 203 in accordance with an embodiment of the present invention. As noted above, spray chamber 203 houses ESI probe 112 with probe shroud 114 and endcap 122, shown in close-up in FIG. 5. FIG. 6 illustrates the mass spectrometer system 100 with the spray chamber 203 and endcap 122 removed revealing nose piece 124 and a nut 127 in accordance with an embodiment of the present invention.

Figure 7:
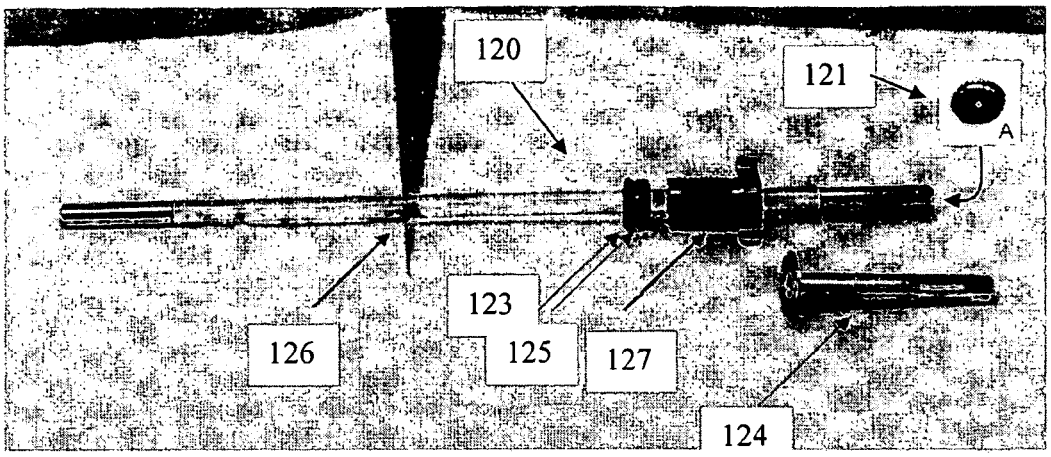
FIG. 7 illustrates a capillary assembly in accordance with an embodiment of the present invention.

FIG. 7 illustrates capillary assembly 120 of mass spectrometer system 100 in accordance with an embodiment of the present invention. Capillary assembly 120 includes nose piece 124, a nut 127, a washer 125, an O-ring 123, glass capillary 126, and a metal foil 121 serving to cover and protect the capillary entrance and provide electrical conductivity. Portions of capillary assembly 120 may be housed in capillary housing 205 (FIG. 1).

In one embodiment of the present invention, contamination is minimized by utilizing inert or high purity polymer material or highly inert metal or metal alloy for parts associated with or that come into direct contact with the sample and/or ion pathways. For example, union 111, ESI probe 112, probe shroud 114, endcap 122, skimmer cone 132, and parts of ion guide 142 may be comprised of such inert or high purity material.

In one example, union 111 may be comprised of polyetheretherketone (PEEK), ESI probe 112 may be comprised of platinum and/or platinum-iridium alloy, probe shroud 114 may be comprised of polychlorotrifluoroethylene (PCTFE) resin (e.g., Kel-F®, Diaflon®, or Aclon®), and endcap 122 and skimmer cone 132 may include a platinum coating. Previously, most parts were disadvantageously comprised of stainless steel, which is not optimally inert and therefore does not minimize contamination. Of serious concern is the fact that a pathway part is composed of the materials that must be measured to trace contamination levels in process solutions, for example in the semiconductor industry. Even trace amounts of contamination from the ESI-TOF MS components may be at or above the levels that must be measured in process solutions. Thus, highly inert or high purity material is needed.

Figure 8A:
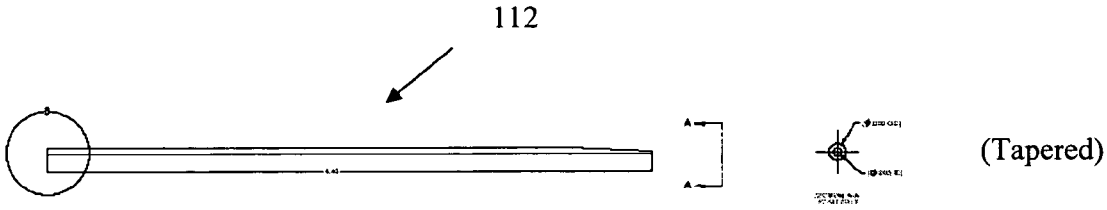
FIGS. 8A through 8C illustrate different embodiments of an ESI probe profile in accordance with an embodiment of the present invention.
Figure 8B:
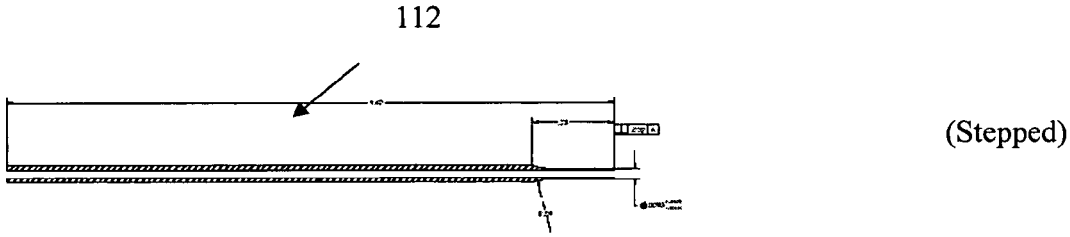
Figure 8C:
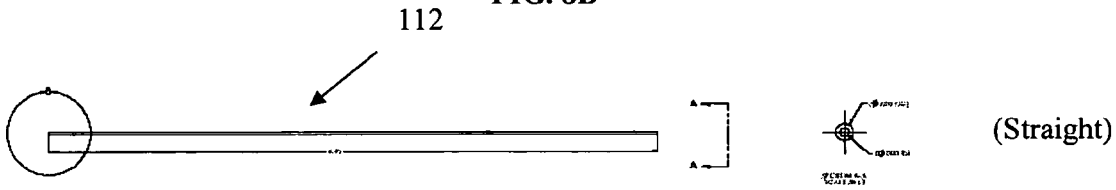

In another embodiment, the overall performance of the mass spectrometer is improved by various other enhancements. Referring to FIGS. 8A-8C, changing the shape of ESI probe 112 from a tapered shape (e.g., similar to a cone shape) (FIG. 8A) or a stepped shape (FIG. 8B) to a straight or linear profile (FIG. 8C) advantageously reduces erosion and provides an improved signal that is stable for longer periods, as well as for easy manufacture.

The use of a metal foil with a hole in the middle 121 (FIG. 5) (e.g., platinum, nickel, aluminum, or other substantially inert metal or metal alloy) provides the necessary electrical conduction to the end cap while being easily changed as contamination builds up on its surface. This contamination occurs during normal spectrometer operation and may be an insulating layer that can charge up and deflect ions away from the desired path. Since the foil can be changed easily and quickly (vs. breaking vacuum and removing and cleaning the capillary end), this avoids significant downtime and more complicated maintenance procedures.

Embodiments described above illustrate but do not limit the invention. It should also be understood that numerous modifications and variations are possible in accordance with the principles of the present invention. Accordingly, the scope of the invention is defined by the following claims.

We claim:

1. A mass spectrometer apparatus for monitoring a fluid system, comprising:

a sample introduction tube;

an electrospray ionization (ESI) probe with a shroud;

a union coupling the sample introduction tube and the ESI probe;

a capillary assembly with an endcap to which the ESI probe is operably aligned, the capillary assembly including a capillary having a metal foil cap covering an end of the capillary;

a skimmer cone operably coupled to the capillary assembly; an ion guide operably coupled to the skimmer cone; and an ion detection module operably coupled to the ion guide, wherein the ESI probe, the shroud, the union, the endcap, and the skimmer cone are comprised of a substantially inert material to provide a substantially inert pathway for ion analysis.

2. The apparatus of claim 1, wherein the ESI probe has a linear profile.

3. The apparatus of claim 1, wherein the substantially inert material is a polymer selected from the group consisting of polyetheretherketone, polychlorotrifluoroethylene, and other fluoropolymers such as perfluoro-alkoxyalkane.

4. The apparatus of claim 1, wherein the metal foil cap is comprised of a substantially inert metal or alloy thereof.

5. The apparatus of claim 1, wherein the substantially inert metal is selected from the group consisting of platinum, gold, aluminum, platinum-iridium alloy, nickel, and alloys thereof.

6. The apparatus of claim 1, wherein the ion detection module includes an electrospray ionization time-of-flight mass spectrometer.

7. An inline electrospray ionization time-of-flight mass spectrometer apparatus for monitoring a fluid system, comprising:

a sample introduction tube comprised of perfluoroalkoxyalkane;

an electrospray ionization (ESI) probe comprised of platinum or platinum-iridium alloy;

a probe shroud comprised of polychlorotrifluoroethylene;

a union coupling the sample introduction tube and the ESI probe, the union comprised of polyetheretherketone;

a capillary assembly with an endcap and a nose piece to which the ESI probe is operably aligned, the endcap including a platinum coating;

a skimmer cone operably coupled to the capillary assembly, the skimmer cone including a platinum coating;

an ion guide operably coupled to the skimmer cone; and an ion detection module operably coupled to the ion guide, wherein a substantially inert pathway is provided to the ion detection module for ion analysis.

8. The apparatus of claim 7, wherein the electrospray ionization probe has a linear profile.

9. The apparatus of claim 7, wherein the capillary assembly further comprises a replaceable metal foil covering the capillary assembly entrance, the metal foil being comprised of a substantially inert metal or alloy thereof.

10. The apparatus of claim 9, wherein the substantially inert metal is selected from the group consisting of platinum, gold, aluminum, platinum-iridium alloy, nickel, and alloys thereof.

11. A method of using an electrospray mass spectrometer, the electrospray mass spectrometer including a capillary a capillary assembly with an endcap to which the ESI probe is operably aligned, the capillary assembly including a capillary having a metal foil cap covering an end of the capillary; the method comprising:

ionizing samples through the capillary assembly such that the metal foil cap becomes a contaminated metal foil cap; and replacing the contaminated metal foil cap with a new metal foil cap on the end of the capillary.

12. The method of claim 11, further comprising ionizing samples through the capillary assembly having the new metal foil cap.

* * * * *